US009359846B2

(12) United States Patent
Martinez et al.

(10) Patent No.: US 9,359,846 B2
(45) Date of Patent: Jun. 7, 2016

(54) HYDRAULIC DEPLOYMENT OF A WELL ISOLATION MECHANISM

(75) Inventors: Ruben Martinez, Houston, TX (US); Sarah Blake, Sugar Land, TX (US)

(73) Assignee: Schlumberger Technology Company, Sugar Land, TX (US)

( * ) Notice: Subject to any disclaimer, the term of this patent is extended or adjusted under 35 U.S.C. 154(b) by 812 days.

(21) Appl. No.: 13/518,263

(22) PCT Filed: Dec. 22, 2010

(86) PCT No.: PCT/US2010/061718

§ 371 (c)(1), (2), (4) Date: Nov. 15, 2012

(87) PCT Pub. No.: WO2011/079169

PCT Pub. Date: Jun. 30, 2011

(65) Prior Publication Data

US 2013/0056200 A1 Mar. 7, 2013

Related U.S. Application Data

(60) Provisional application No. 61/290,000, filed on Dec. 23, 2009.

(51) Int. Cl.
*E21B 23/06* (2006.01)
*E21B 47/06* (2012.01)

(52) U.S. Cl.
CPC ..... *E21B 23/06* (2013.01); *E21B 47/06* (2013.01)

(58) Field of Classification Search
None
See application file for complete search history.

(56) References Cited

U.S. PATENT DOCUMENTS

| | | | | |
|---|---|---|---|---|
| 3,661,205 | A | 5/1972 | Belorgey | |
| 4,102,394 | A | 7/1978 | Botts | |
| 5,033,549 | A | 7/1991 | Champeaux et al. | |
| 5,115,860 | A | 5/1992 | Champeaux et al. | |
| 5,224,547 | A | 7/1993 | Burns, Sr. et al. | |
| 5,228,507 | A | 7/1993 | Obrejanu et al. | |
| 5,228,519 | A * | 7/1993 | Coronado et al. | 166/387 |
| 5,240,077 | A * | 8/1993 | Whitsitt | 166/383 |
| 5,277,253 | A * | 1/1994 | Giroux et al. | 166/187 |
| 5,310,001 | A | 5/1994 | Burns, Sr. et al. | |
| 5,322,118 | A | 6/1994 | Terrell | |
| 5,392,715 | A | 2/1995 | Pelrine | |
| 5,398,753 | A | 3/1995 | Obrejanu et al. | |

(Continued)

FOREIGN PATENT DOCUMENTS

| | | |
|---|---|---|
| GB | 2330598 A | 4/1999 |
| RU | 2241109 C2 | 11/2004 |

(Continued)

OTHER PUBLICATIONS

International Search Report & Written Opinion issued in PCT/US2010/061718 (25.0560-WO-PCT) on Aug. 11, 2011; 9 pages.

*Primary Examiner* — Jennifer H Gay
*Assistant Examiner* — Caroline Butcher
(74) *Attorney, Agent, or Firm* — Trevor Grove

(57) ABSTRACT

A hydraulic setting tool. The tool is configured to allow hydraulic setting of a bridge plug, packer or other radially expansive mechanical well isolation mechanism. Wireline or slickline deployment may be utilized. In either case, parameters of the setting application may be recorded. In the case of wireline deployment such parameters and downhole data may be monitored in real-time allowing an operator to make intelligent setting application adjustments as necessary.

14 Claims, 6 Drawing Sheets

(56) References Cited

U.S. PATENT DOCUMENTS

| | | | | |
|---|---|---|---|---|
| 5,575,331 | A | 11/1996 | Terrell | |
| 5,592,991 | A | 1/1997 | Lembcke et al. | |
| 5,636,689 | A | 6/1997 | Rubbo et al. | |
| 5,675,088 | A | 10/1997 | Serata | |
| 5,778,980 | A | 7/1998 | Comeau et al. | |
| 5,947,213 | A | 9/1999 | Angle et al. | |
| 5,961,252 | A | 10/1999 | Mercer et al. | |
| 6,029,744 | A | 2/2000 | Baird | |
| 6,041,856 | A | 3/2000 | Thrasher et al. | |
| 6,041,860 | A | 3/2000 | Nazzal et al. | |
| 6,112,809 | A | 9/2000 | Angle | |
| 6,158,529 | A | 12/2000 | Dorel | |
| 6,179,066 | B1 | 1/2001 | Nasr et al. | |
| 6,196,309 | B1 | 3/2001 | Estilette, Sr. | |
| 6,206,108 | B1 | 3/2001 | MacDonald et al. | |
| 6,216,784 | B1 | 4/2001 | Harrell | |
| 6,216,789 | B1 | 4/2001 | Lorsignol et al. | |
| 6,257,332 | B1 | 7/2001 | Vidrine et al. | |
| 6,281,489 | B1 | 8/2001 | Tubel et al. | |
| 6,868,901 | B2 | 3/2005 | Mason et al. | |
| 6,868,906 | B1 | 3/2005 | Vail, III et al. | |
| 7,051,810 | B2 | 5/2006 | Clemens et al. | |
| 7,096,976 | B2 | 8/2006 | Paluch et al. | |
| 7,201,230 | B2 * | 4/2007 | Schultz | E21B 23/04 166/319 |
| 7,219,747 | B2 | 5/2007 | Gleitman et al. | |
| 7,246,662 | B2 | 7/2007 | Jabusch et al. | |
| 7,284,613 | B2 | 10/2007 | Billingham et al. | |
| 7,458,423 | B2 | 12/2008 | Vercaemer et al. | |
| 7,540,327 | B2 | 6/2009 | Billingham | |
| 7,559,361 | B2 | 7/2009 | Obrejanu | |
| 7,607,478 | B2 | 10/2009 | Martinez et al. | |
| 7,661,477 | B2 | 2/2010 | Sheiretov et al. | |
| 7,886,834 | B2 | 2/2011 | Spencer et al. | |
| 8,028,752 | B2 | 10/2011 | Richards | |
| 8,220,541 | B2 | 7/2012 | Martinez et al. | |
| 8,286,716 | B2 | 10/2012 | Martinez et al. | |
| 2001/0050172 | A1 * | 12/2001 | Tolman et al. | 166/297 |
| 2003/0164240 | A1 | 9/2003 | Vinegar et al. | |
| 2003/0234111 | A1 | 12/2003 | Echols et al. | |
| 2004/0020644 | A1 | 2/2004 | Wilson et al. | |
| 2004/0112597 | A1 | 6/2004 | Hamid et al. | |
| 2004/0244475 | A1 | 12/2004 | Butler et al. | |
| 2005/0115741 | A1 | 6/2005 | Terry et al. | |
| 2005/0145415 | A1 | 7/2005 | Doering et al. | |
| 2005/0217350 | A1 | 10/2005 | Jabusch et al. | |
| 2005/0263281 | A1 | 12/2005 | Lovell et al. | |
| 2006/0254768 | A1 | 11/2006 | De Jesus et al. | |
| 2006/0272809 | A1 | 12/2006 | Tubel et al. | |
| 2008/0230235 | A1 | 9/2008 | Loughlin | |
| 2009/0095490 | A1 * | 4/2009 | Moriarty | E21B 31/107 166/383 |
| 2010/0018703 | A1 | 1/2010 | Lovell et al. | |

FOREIGN PATENT DOCUMENTS

| | | | |
|---|---|---|---|
| WO | 9812418 | A2 | 3/1998 |
| WO | 2004074630 | A1 | 9/2004 |
| WO | 2007123417 | A1 | 11/2007 |
| WO | 2008111844 | A1 | 9/2008 |

* cited by examiner

HYDRAULIC DEPLOYMENT OF A WELL ISOLATION MECHANISM

FIELD

Embodiments described relate to setting tools for mechanical packers, plugs and any other radially expandable and/or compressible downhole element. In particular, setting tools which provide setting force in a hydraulic manner are disclosed. These setting tools may also be deployed via conventional wireline or in conjunction with measurement devices, thereby allowing for real time telemetry or other recording of setting measurements.

BACKGROUND

Exploring, drilling and completing hydrocarbon and other wells are generally complicated, time consuming, and ultimately very expensive endeavors. As a result, over the years, a significant amount of added emphasis has been placed on well monitoring and maintenance. Once more, perhaps even more emphasis has been directed at initial well architecture and design. All in all, careful attention to design, monitoring and maintenance may help maximize production and extend well life. Thus, a substantial return on the investment in the completed well may be better ensured.

In the case of well monitoring and logging, mostly minimally-invasive applications may be utilized which provide temperature, pressure and other production related information. By contrast, well design, completion and subsequent maintenance, may involve a host of more direct interventional applications. For example, the removal of debris or tools and equipment may be required or entire downhole regions may closed off from production. In certain instances, high pressure perforating and stimulating of well regions may be called for. In this case, the active intervention may be preceded by the added intervention of closing off and isolating the well regions with mechanisms capable of accommodating such high pressure applications.

Closing off of a well region for a subsequent high pressure application may be achieved by way of one or more mechanical plugs or packers. Such mechanisms may be positioned at downhole locations and serve to seal off a downhole region adjacent thereto. These mechanisms are configured to accommodate the high pressures associated with perforating or stimulating as noted. Thus, they are generally radially expandable in nature through the application of substantial compressive force as described below. In this manner, slips of the radially expandable mechanisms may be driven into engagement with a casing wall of the well so as to ensure its sufficient anchoring. By the same token, the radial responsiveness of elastomeric portions of the mechanisms may help ensure adequate sealing for the high pressure application to be undertaken.

Unfortunately, delivering and setting such mechanical isolation mechanisms often involves the use of an explosive setting tool. That is to say, a mechanical packer may be positioned by conventional line delivery equipment such as wireline or coiled tubing. However, upon reaching the targeted location downhole, an explosive setting tool coupled to the mechanical packer is used to trigger its deployment. More specifically, a slow-burning explosive charge may be used to generate a high pressure gas which acts upon a hydraulic assembly in order to set the packer.

A host of drawbacks are associated with such explosive setting of a mechanical isolation mechanism. For example, the once triggered, the operator is left with little control or even feedback as to the manner of packer setting. Rather, a signal for firing of the explosive is initiated followed by a slow burn and initially large, but dissipating, hydraulic pressure. No practical control over the speed or reliability of the setting is available, nor feedback concerning the effective degree of setting. Once more, since the setting tool involves the use of a consumable explosive, there is no manner by which to pre-test the setting tool in a controlled environment. That is, the explosive charge may be used only a single time.

Further complicating matters is the fact that these most commonly utilized of setting tools are explosively driven. For safety and security reasons, this can lead to significant delays where their transport to the oilfield is required, particularly where international transport is involved. Indeed, even where delays are avoided, inherent hazards to personnel are involved in the transport of such materials.

In an effort to avoid the use of explosive materials for setting mechanically deployable isolation mechanisms, screw-type linear actuators have been developed in recent years. Such tools are electrically driven and may produce a sufficiently large force for mechanical packer or plug setting from an appropriately sized downhole electric motor. Unfortunately, however, these tools may not be particularly efficient in operation and, due to significant power requirements for starting, may be left inoperable should they stall during operations. Thus, as a practical matter, setting of mechanical isolation devices remains primarily driven by the potentially hazardous and inconsistent drive of blind explosive setting tools.

SUMMARY

An assembly is provided for providing isolation in a well. The assembly includes a hydraulic setting tool coupled to a well isolation mechanism. The tool is coupled to a wireline cable which is configured for directing deployment of the tool into the well along with setting of the mechanism at a location in the well for the isolation.

A method is disclosed whereby a radially expandable isolation mechanism is set in a well. The method includes deploying a hydraulic setting tool into the well over a wireline cable, the tool being coupled to the mechanism. The tool may then be directed over the cable to actuate the mechanism for radial expansion thereof.

DETAILED DESCRIPTION

Embodiments herein are described with reference to downhole applications employing mechanical plugs and packers for high pressure isolation applications. For example, these embodiments focus on the use of mechanisms for isolation in advance of high pressure perforating or fracturing applications. However, a variety of alternative, perhaps lower pressure applications may be pursued in conjunction with such mechanisms. Regardless, embodiments of the mechanisms detailed herein are set in place downhole by a hydraulic setting mechanism.

Figure 1A:
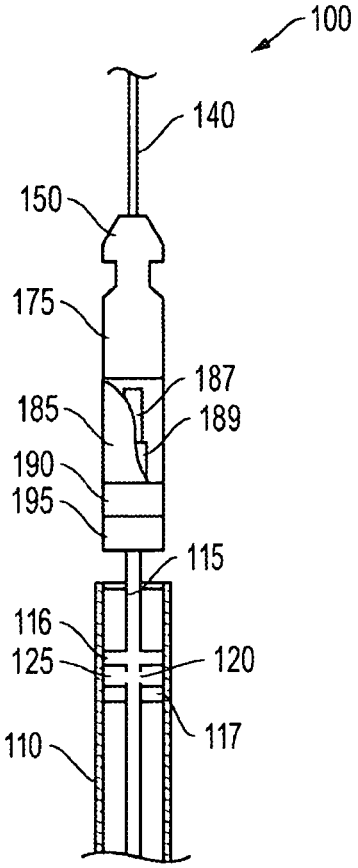
FIG. 1A is a side partially-sectional view of an embodiment of a hydraulic setting tool in a pre-setting position for a well isolation mechanism.
Figure 1B:
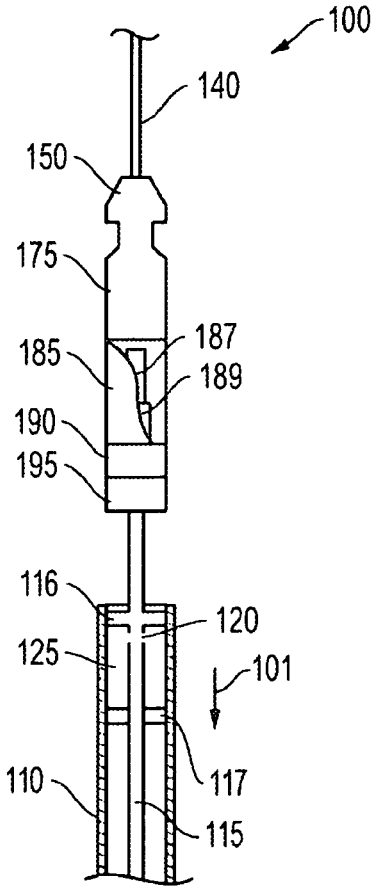
FIG. 1B is a side partially-sectional view of the hydraulic setting tool of FIG. 1A in a position upon setting the mechanism.
Figure 2:
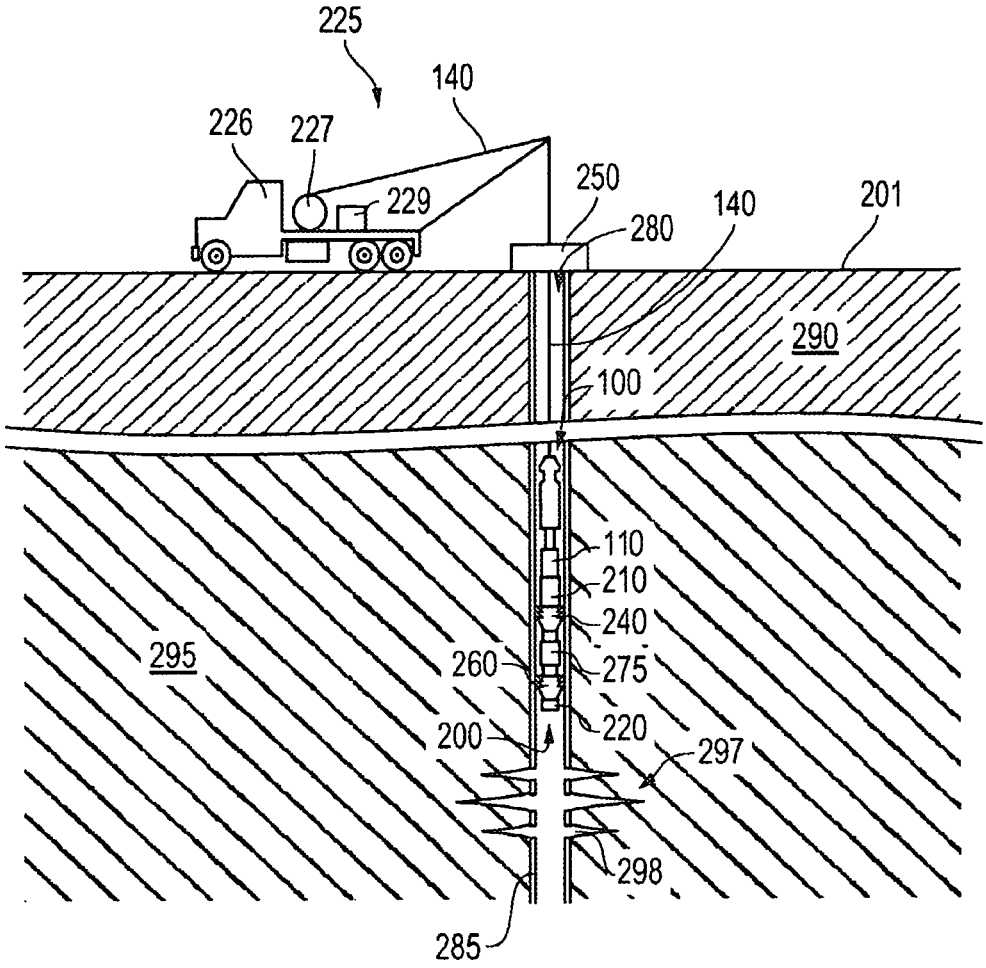
FIG. 2 is an overview of an oilfield accommodating a well with the hydraulic setting tool and referenced isolation mechanism disposed therein.

Referring now to FIG. 1A, with added reference to FIG. 2, a side partially-sectional view of an embodiment of a hydraulic setting tool 100 is depicted. The tool 100 is configured for setting a well isolation mechanism, such as a bridge plug 200, in a well 280. Although in other embodiments, the tool 100 may be configured for use in conjunction with a mechanical packer or other well isolation mechanism. Regardless, the tool 100 includes a housing sleeve 110 which may be hydraulically driven for directing the setting of the plug 200 in the well 280. Indeed, in the embodiment of FIG. 1A, the sleeve 110 is in a pre-setting position which is utilized in advance of locating the plug 200 at a targeted downhole location for isolation. By way of contrast, the sleeve 110 may be shifted in a downhole direction 101, as shown in FIG. 1B, once the plug 200 has been located for setting in the well 280.

Continuing with reference to FIG. 1A, however, the hydraulic setting tool 100 is shown secured to a wireline cable 140 at its head 150. Thus, hydraulics for driving the noted housing sleeve 110 may be powered over the cable 140 from surface. Furthermore, real-time telemetry over electronics of the cable 140, or through associated fiber optics thereof, may also be available. As a result, diagnostics, feedback and responsive control over setting of the plug 200 with the hydraulic tool 100 may be reasonably available. For example, in the embodiment shown, a pressure sensor 190 and control valve 195 may be incorporated into the tool 100 to allow for intelligent control over the setting application as detailed below.

In an alternate embodiment, deployment of the tool 100 and plug 200 into the well may be achieved by way of slickline or other non-powered line. In such an embodiment, powering of hydraulics may be achieved by way of a suitably sized downhole power source (e.g. a lithium-based battery) coupled to the tool 100. Nevertheless, parameters such as the noted pressure and other conditions of the setting application, may be recorded for subsequent analysis at surface.

In the embodiment shown, the hydraulic setting tool 100 is equipped with an electronics housing 175 for directing the setting application through an adjacent power housing 185. This housing 185 accommodates a downhole motor 187 and pump 189 for driving of the housing sleeve 110 as noted above. The pump 189 may be an axial piston pump, such as the commercially available AKP model from Bieri™ Hydraulics of Switzerland. However, a variety of other axial piston pump models, suitably sized for downhole use may be utilized. Regardless, the pump 189 is configured to supply in excess of about 7,500 PSI for adequate setting of the plug 200 as detailed below.

Continuing with reference to FIG. 1A, the shifting of the housing sleeve 110 as described above and depicted at FIG. 1B is effectuated by the influx of hydraulic fluid into a sleeve chamber 125 through ports 120. That is to say, an extension 115 below the pump 189 may accommodate hydraulics leading to the indicated ports 120. Further, the chamber 125 is defined by the noted sleeve 110 along with a chamber wall 117 which is affixed to the sleeve 110 as a unitary part thereof. By the same token, opposite the chamber wall 117, the chamber 125 is defined by an extension wall 116 that is unitarily a part of the extension 115. However, the extension wall 116 and the sleeve 110, while sealingly engaged, are also slidable relative to one another. Thus, an influx of hydraulic fluid into the chamber 125 may be utilized to drive up the pressure therein until shifting of the sleeve 110 is attained (see arrow 101 of FIG. 1B).

In the manner described above, embodiments of the hydraulic setting tool 100 are configured to provide enough setting force to attain setting of a radially expandable, mechanical well isolation mechanism such as the plug 200 of FIG. 2. Indeed, with reference to FIG. 1B, the detailed sleeve 110 is moved into a setting position with the chamber 125 enlarged by the influx of hydraulic fluid as directed by the pump 189. In the embodiment shown, the pressure of the fluid buildup in the chamber 125 may be monitored by the sensor 190 during a setting application. Indeed, even displacement may be accurately accounted for by monitoring of pump speed. As indicated above, these measurements may be kept track of in real time or stored for later use.

As an alternative to fluid monitoring, force may be tracked by use of a strain gauge-based force transducer or other non-fluid measurement device. Regardless, the availability and manner of monitoring components of the hydraulic tool 100 allow for testing of thereof in advance of a setting application (i.e. unlike an explosive driven tool). So, for example, the tool 100 may be tested to ensure that it is capable of generating the requisite force for setting a given plug 200 such as that of FIG. 2 in advance of its deployment into the well 280. Thus, before the assembly is ever taken to the oilfield 201, the possibility of a failed setting application may be ruled out along with the need for any costly fishing expedition for tool 100 and plug 200 retrieval.

Such advance testing of the tool 100 may also be utilized to determine a maximum system pressure that may be tolerated. So, for example, in one embodiment a relief valve may be incorporated into the tool 100 and set to allow fluid release at a predetermined pressure, such as just below the maximum system pressure. As a result, damage due to excess pressure may be avoided. At the same time, proper pretesting of the tool 100 and its force generating capacity as noted above ensures that even with such pressure relief, the setting application would not be compromised.

Referring more specifically now to FIG. 2, an overview of the oilfield 201 is shown. The well 280 at the oilfield 201 traverses various formation layers 290, 295 and accommodates the setting tool 100 and bridge plug 200 as described above. Once more, the well 280 is defined by a casing 285 that is configured for sealing and anchored engagement with the plug 200 upon the setting. That is to say, the plug 200 is equipped with upper 240 and lower 260 slips to achieve anchored engagement with the casing 285 upon the setting. Similarly, a generally elastomeric, sealing element 275 is disposed between the slips 240, 260 to provide sealing of the plug 200 relative the casing 285 by way of the setting application.

The assembly of the setting tool 100 and plug 200 also includes a platform 220 at its downhole end. This platform 220 is coupled internally to the extension 115 of the tool 100 (see FIGS. 1A and 1B). Thus, the plug 200 is compressed between this platform 220 and the housing sleeve 110, as this sleeve 110 is forced against a plug sleeve 210 of the plug 200. In this way, the setting application ultimately radially expands plug components into place once the plug 200 is positioned in a targeted location.

In the embodiment shown, the targeted location for placement and setting of the plug 200 is immediately uphole of a production region 297 with defined perforations 298. So, for example, the plug 200 may be utilized to isolate the region 297 for subsequent high pressure perforating or stimulating applications in other regions of the well 280.

Continuing with reference to FIG. 2, the wireline delivery of the assembly means that even though a relatively high powered setting application is undertaken, it may be done so with relatively small mobile surface equipment 225. Indeed, the entire assembly traverses the well head 250 and is tethered to a spool 227 of a wireline truck 226 without any other substantial deployment equipment requirements. In the embodiment shown, a control unit 229 for directing the deployment and setting is also shown. The control unit 229 may ultimately be electrically coupled to downhole electronics of the setting tool 100 so as to monitor and intelligently control the setting of the plug 200. That is to say, the unit 229 may initiate setting and also modify the application in real time, depending on monitored pressure and other application data as described above.

Figure 3C:
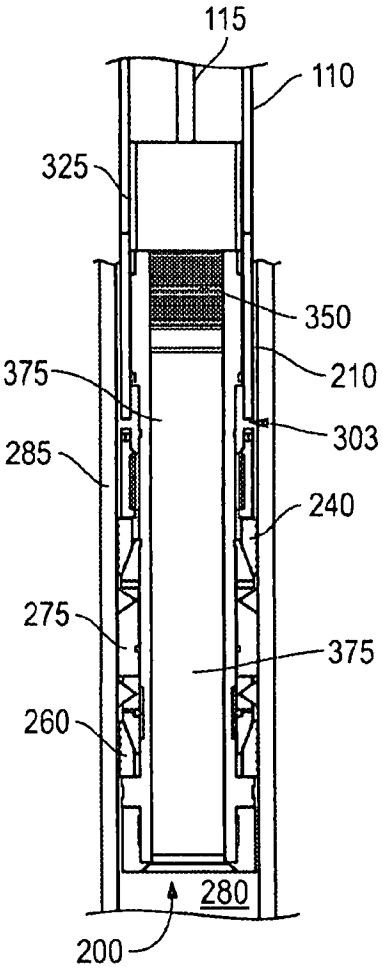
FIG. 3C is a side cross-sectional view of the isolation mechanism of FIG. 3B upon setting of upper slip rings thereof by the setting tool.
Figure 3B:
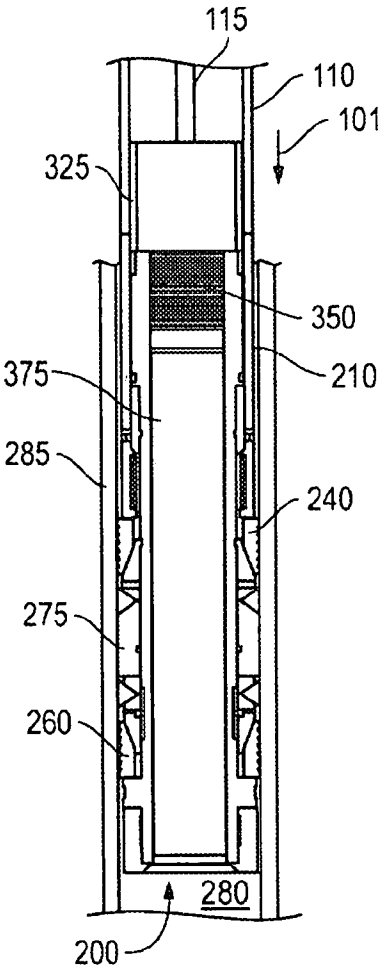
FIG. 3B is a side cross-sectional view of the isolation mechanism of FIG. 3A upon sealing engagement by a seal thereof as directed by the setting tool.
Figure 3A:
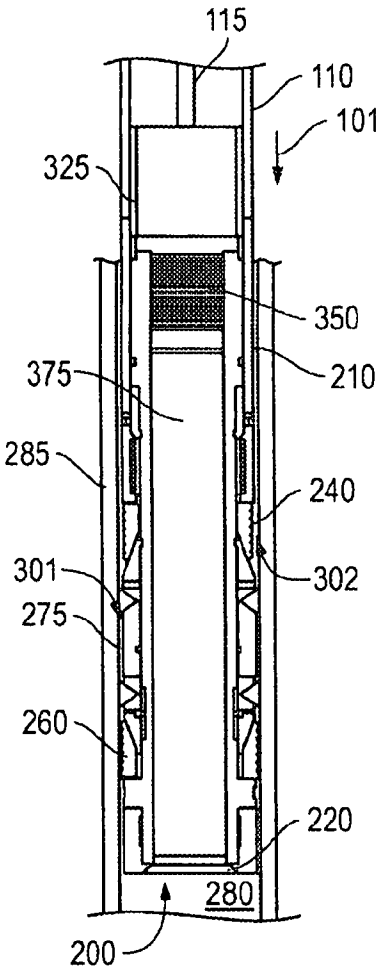
FIG. 3A is a side cross-sectional view of the isolation mechanism of FIG. 2 upon initial setting of lower slip rings by the setting tool.

Referring now to FIGS. 3A-3C, the mechanics of radially expanding components of the plug 200 are shown in stages. That is, as noted above, plug components radially expand as a result of the downward movement 101 of the housing sleeve 110 toward the platform 220. More specifically, the platform 220 is ultimately physically coupled to the extension 115 by way of a central mandrel 375, plug head 350, and tool coupling 325. Yet, at the same time, the platform 220 serves as a backstop to downward movement of non-central plug components such as the slips 240, 260, seal 275, sleeve 210, etc. Thus, the depicted movement 101 of the housing sleeve 110 tends to compress plug components therebetween until the plug 200 is set against the casing 285.

With specific reference to FIG. 3A, the plug 200 is compressed upon initial setting of lower slip rings 260 by the downward movement 101 of the housing sleeve 110. That is, as the force of the downward movement 101 is translated through the plug sleeve 210 and other plug components, the radially expandable component closest the platform 220 begins its expansion. Thus, in FIG. 3A, teeth of the lower slips 260 are shown engaging and biting into the casing 285 defining the well 280. As a result, anchoring of the plug 200 has begun. At the same time, however, the seal 275 and upper slips 240 have yet to be substantially compressed. Therefore, interfacing spaces 301, 302 remain between these components and the casing 285.

Referring to FIG. 3B, however, as the housing sleeve 110 continues to move in the downward direction, the indicated spaces 301, 302 disappear. This disappearance takes place as the seal 275 begins to fully engage the casing 285 and the upper slips 240 begin to make contact with the casing 285. Thus, the anchoring of the plug 200 and the sealing isolation of the well 280 can be seen beginning to take hold. It is worth noting that as this compression of the plug 200 continues, its general location within the well 280 is unaffected. That is to say, the downward movement 101 of the sleeve 110 acts against the platform 220 to achieve the noted compression as opposed to having any significant affect on the plug 200 depth in the well 280.

Referring now to FIG. 3C, the continued compression described above ultimately results in complete anchoring of the upper slips 240 into the casing 285. Furthermore, the compression may continue to a degree, further driving on the newly anchoring slips 240 and energizing the seal 275 to enhance anchoring and sealing capacity of the plug 200. This, along with the sequential setting of plug components apparent in FIGS. 3A-3C, may be viewed graphically in the chart of FIG. 5 detailed below.

Figure 4:
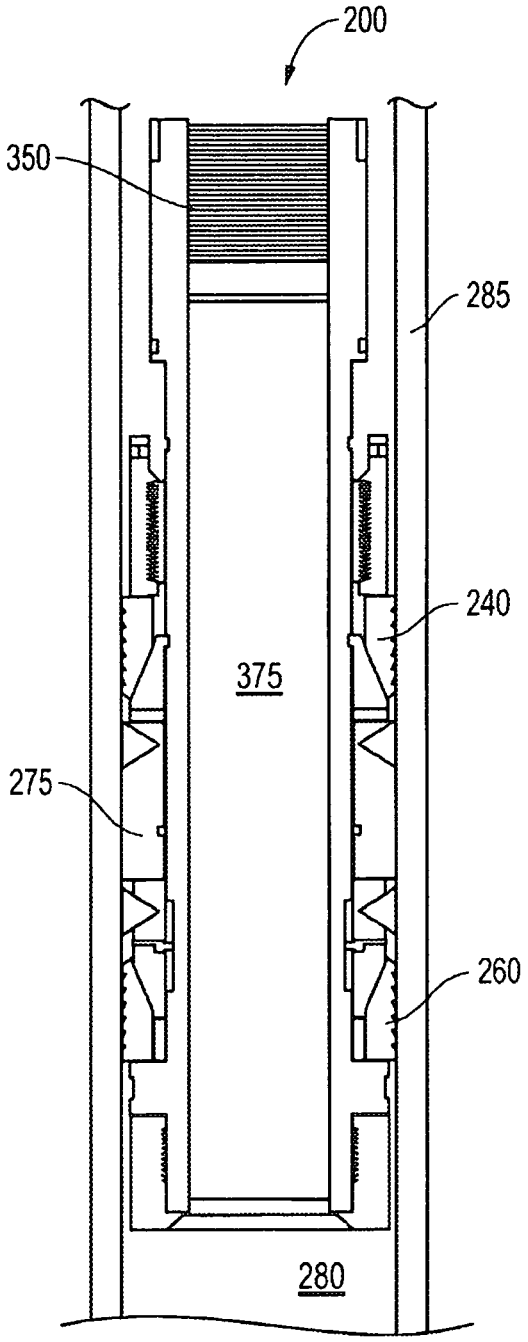
FIG. 4 is a side cross-sectional view of the isolation mechanism of FIG. 3C upon completed anchoring and sealed engagement in the well.

Referring now to FIG. 4, with added reference to FIGS. 2 and 3C, a side cross-sectional view of the plug 200 is shown following the setting application. The plug 200 is now fully anchored and the well 280 sealingly isolated. Furthermore, the setting tool 100 is removed from engagement with the plug 200, and indeed from the entire well 280. This is made possible by the breaking of a tension stud within the plug mandrel 375 which leads to the separation 303 shown in FIG. 3C. As shown, the withdrawal of the setting tool 100 from the well 280 may pull out the engaged housing 110 and plug 210 sleeves along with the engaged extension 115 and tool coupling 325. However, in other embodiments, the particular interfacing components of the tool 100 and plug 200 which are left or withdrawn may vary along with the particular location of the separation 303. Regardless, a setting of a plug 200 has now been fully completed by way of a hydraulic setting tool 100.

Figure 5:
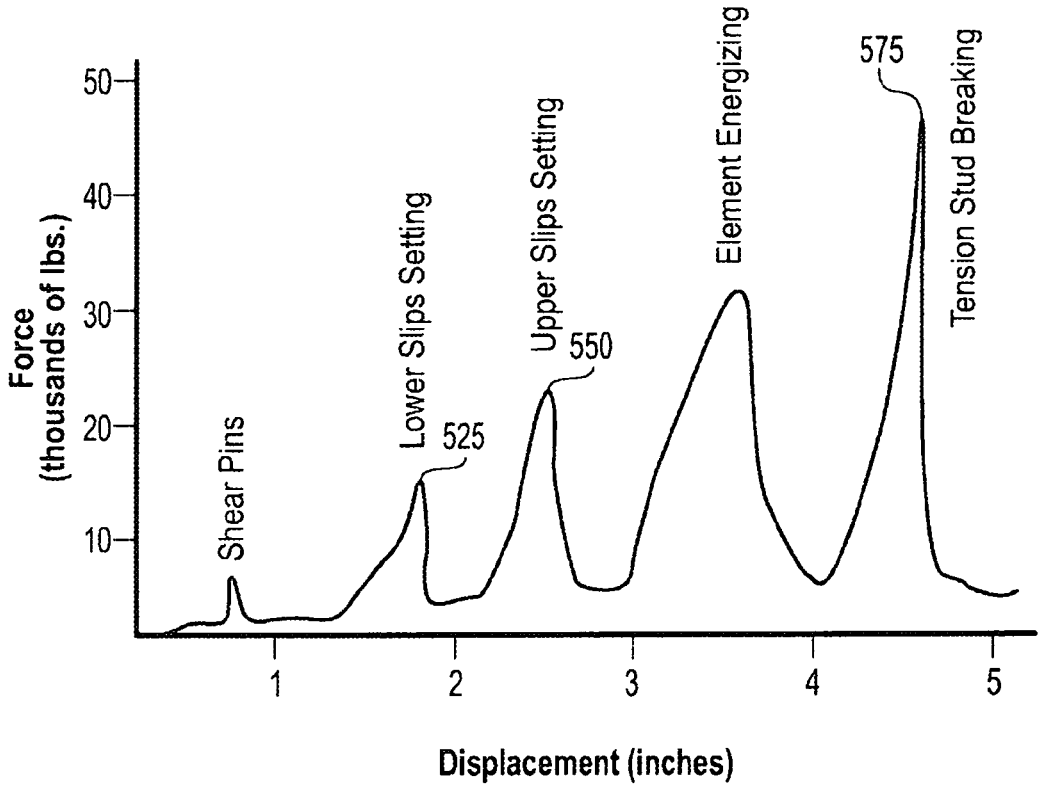
FIG. 5 is a chart depicting displacement of an isolation mechanism by the hydraulic setting tool of FIGS. 3A-3C and FIG. 4 as charted against the setting force.

Referring now to FIG. 5, a chart is shown depicting the forces imparted on the plug by way of the setting tool as charted against its compressing displacement over the course of a setting application. So, for example, breaking of the tension stud in completing the setting takes place upon just under about 50,000 lbs. of force. In one embodiment, this may be achieved by the generation of between in excess of about 7,500 PSI by the hydraulic setting tool 100 according to the mechanics detailed in FIGS. 1A and 1B above. Further, in getting to the completed setting, it can be seen that a displacement of just under about 5 inches has taken place, for example, in terms of the amount of housing sleeve 110 movement.

Continuing with reference to FIG. 5, the sequential setting or other affects on plug components with lesser forces and degrees of displacement may be seen. For example, shear pins of the plug are generally initially broken to begin the setting sequence followed by setting of the lower slips, the upper slips, and then the further energizing of the seal element. Of course, sealing may begin earlier, for example prior to setting of the upper slips. However, the continued downward movement of the housing sleeve leads to the forces of seal energizing following setting of all slips.

FIG. 5 also reveals a sharp drop off in force following breaking or setting of plug elements (e.g. note peaks 525, 550, 575). In the case of shear pin or stud breaking, this is due to the sudden disappearance of the affect of in-tact pins or stud on the system. Similarly, upon setting of the slips, a radial expansion has taken place which breaks apart individual teeth of the slips projecting them outward into the casing. While this serves to anchor the plug, it also results in less structural resistance to the advancing housing sleeve. Thus, the drop in force is apparent after such settings in the chart of FIG. 5. Indeed, peaks seen in the setting of such hard plug elements are more marked as compared to the broader energizing of the elastomeric seal element, a generally more gradual undertaking without sudden structural disintegration.

Regardless of the particular plug or other isolation mechanism design and setting sequence, it is worth noting that all such force directed events may be recorded and/or monitored by embodiments described herein. For example, where wireline is utilized in conjunction with the hydraulic setting tool, a chart similar to that of FIG. 5 may be developed and monitored over the course of the setting application. Indeed, the application may be slowed down, sped up, or otherwise altered by an operator at surface having such monitoring capability on hand. Even where slickline is utilized, such information may be available for comparison against prior setting application information so as to confirm the effectiveness of the setting application in a manner heretofore unavailable.

Figure 6:
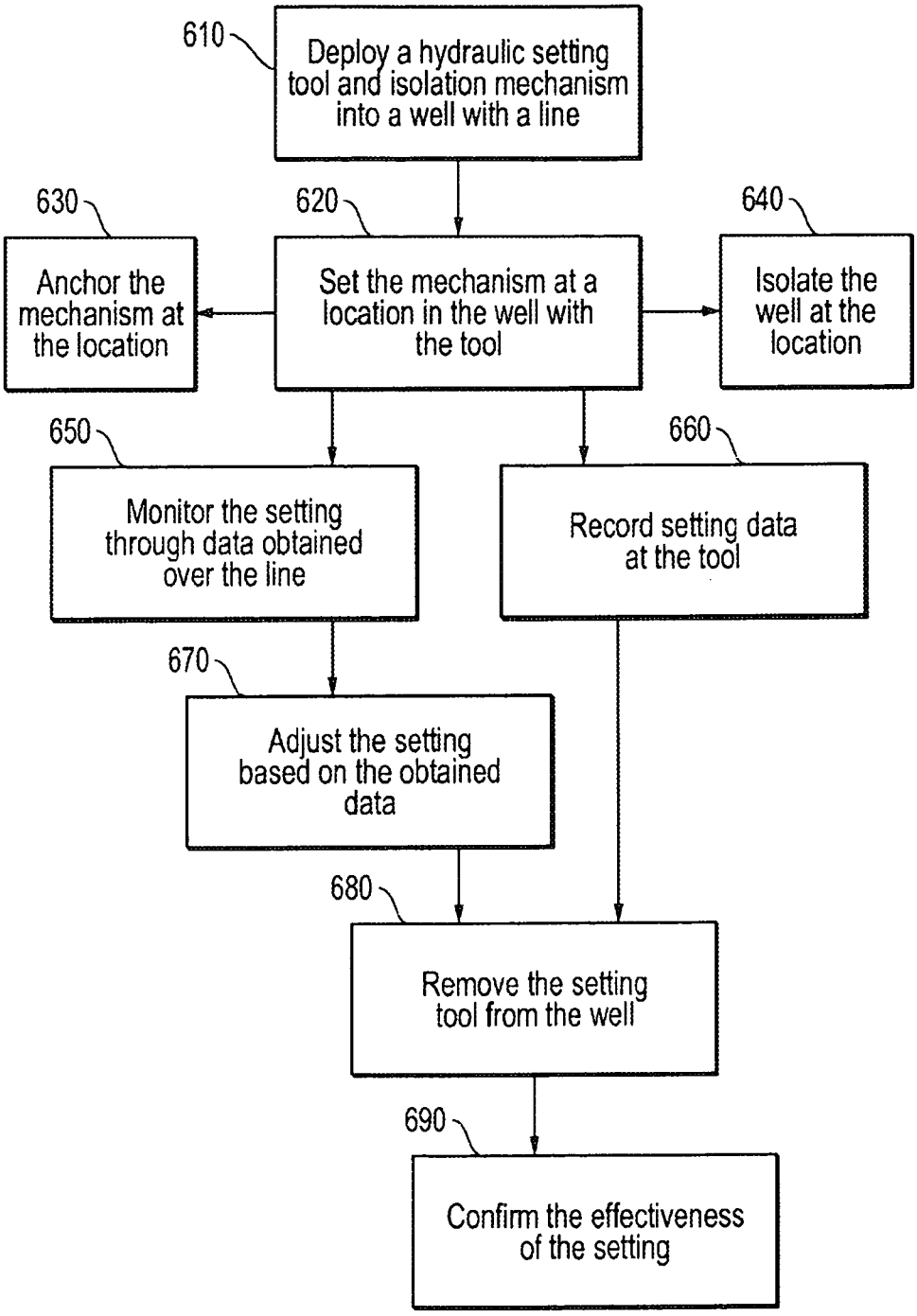
FIG. 6 is a flow-chart summarizing an embodiment of deploying a well isolation mechanism in a well with a hydraulic setting tool.

Referring now to FIG. 6, a flow-chart summarizing an embodiment of deploying and setting an isolation mechanism, such as the above described plug, in a well with a hydraulic setting tool is shown. The setting tool and mechanism may be deployed over a line, such as wireline or slickline, as indicated at 610. The mechanism may then be set (see 620). This may include anchoring the mechanism and sealingly isolating the well therewith as indicated at 630 and 640.

As the mechanism is set, the setting application may be monitored as noted at 650, for example, where wireline is employed. Where such capacity is available, the setting application may be adjusted in real-time based on such acquired data (see 670). Alternatively, as noted at 660, setting application data may still be recorded by the setting tool even where real-time transmission is unavailable (such as where slickline deployment is utilized). Regardless, the tool may then be removed from the well as indicated at 680 and the effectiveness of the setting application confirmed (see 690).

Embodiments described hereinabove utilize a downhole setting tool that is hydraulically driven without the requirement of explosives. Thus, safety and security concerns are substantially alleviated. Additionally, given that the tool is powered without the use of a consumable, the ability to test the setting tool in advance of downhole use is available. Once more, by utilizing hydraulics powered over a wireline or with a downhole power source, the use of screw-type actuators may also be avoided. As such, reliability concerns in terms of stalling and other such downhole malfunctions are largely eliminated.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A method of setting a downhole radially expandable well isolation mechanism in a well, the method comprising:

deploying a hydraulic setting tool into a well using a line, wherein the hydraulic setting tool comprises:

a housing sleeve having an annulus;

a chamber wall connected with an interior surface of the housing sleeve, wherein the chamber wall traverses the annulus; and an extension located within the annulus, wherein the extension has an extension wall connected therewith and wherein the extension wall traverses the annulus and engages an inner surface of the housing sleeve in a sealing relationship, and wherein the extension wall and chamber wall define a sleeve chamber therebetween, and wherein the extension is in communication with a pump, wherein the extension has one or more ports to provide fluid in the sleeve chamber, and wherein the extension is directly coupled with a mechanism;

providing fluid to the sleeve chamber, moving the housing sleeve relative to the extension, thereby setting the mechanism; and measuring the pressure in the sleeve chamber using a sensor and recording setting data during the setting of the mechanism.

2. The method of claim 1, wherein the setting data comprises pressure, pump speed, or combinations thereof.

3. The method of claim 1, wherein the setting data comprises stain gauge measurements acquired during setting.

4. The method of claim 1, wherein the setting further comprises:

anchoring the mechanism at the location; and sealingly isolating the well at the location.

5. The method of claim 1, further comprising:

disconnecting the extension from the mechanism; and removing the hydraulic setting tool from the well.

6. The method of claim 5, further comprising running a perforating application, stimulating application, or combinations thereof.

7. The method of claim 1, wherein the line is a wireline cable.

8. The method of claim 7, further comprising monitoring setting data in real-time over the wireline cable.

9. The method of claim 8, further comprising adjusting the setting based on the monitoring of the setting data.

10. The method of claim 1, further comprising testing the setting tool in advance of deploying.

11. The method of claim 10, wherein the testing comprises ensuring the tool is capable of effectively achieving the setting.

12. The method of claim 10, wherein the testing comprises determining a predetermined system pressure capacity of the tool.

13. A data acquiring hydraulic setting tool comprising:

an extension directly connected with a mechanism at one end and in communication with a pump at another end;

an extension wall connected with the extension;

a port located below the extension wall;

a housing sleeve disposed about the extension, wherein the housing sleeve is configured to move relative to the extension and compress the mechanism, and wherein the extension wall engages an inner surface of the housing sleeve;

a chamber wall connected with an inner surface of the housing sleeve, wherein the chamber wall and extension wall form a sleeve chamber therebetween; and a sensor configured to measure the pressure in the sleeve chamber.

14. An assembly for providing isolation in a well, the assembly comprising:

an extension configured in communication with a pump at one end;

an extension wall connected with the extension;

a port located below the extension wall;

a housing sleeve disposed about the extension, wherein the housing sleeve is configured to move relative to the extension, and wherein the extension wall engages an inner surface of the housing sleeve;

a chamber wall connected with an inner surface of the housing sleeve, wherein the chamber wall and extension wall form a sleeve chamber therebetween;

a sensor configured to measure the pressure in the sleeve chamber; and a mechanism directly connected with another end of the extension and operatively aligned with the housing sleeve, and wherein the mechanism is configured to be released from the extension after actuation of the mechanism.

* * * * *